United States Patent [19]

Ciliberti et al.

[11] Patent Number: 4,604,112

[45] Date of Patent: Aug. 5, 1986

[54] ELECTROSTATIC PRECIPITATOR WITH READILY CLEANABLE COLLECTING ELECTRODE

[75] Inventors: David F. Ciliberti, Murrysville Boro; Thomas E. Lippert, Murrysville, both of Pa.

[73] Assignee: Westinghouse Electric Corp., Pittsburgh, Pa.

[21] Appl. No.: 657,920

[22] Filed: Oct. 5, 1984

[51] Int. Cl.[4] ..... B03C 3/80

[52] U.S. Cl. ..... 55/117; 55/130; 55/151; 55/154; 55/302

[58] Field of Search ..... 55/12, 6, 117, 120, 55/130, 131, 147, 148, 151, 155, 154, 302

[56] References Cited

U.S. PATENT DOCUMENTS

| | | | |
|---|---|---|---|
| 4,077,785 | 3/1978 | Hartshorn | 55/155 |
| 4,233,037 | 11/1980 | Pontius et al. | 55/2 |
| 4,357,151 | 11/1982 | Helfritch | 55/6 |
| 4,473,383 | 9/1984 | Bonser et al. | 55/148 |
| 4,481,017 | 11/1984 | Furlong et al. | 55/12 |

*Primary Examiner*—Bernard Nozick

*Attorney, Agent, or Firm*—Daniel C. Abeles

[57] ABSTRACT

An electrostatic precipitator especially useful in separation of particulate matter from gas streams under high pressure and high temperature conditions has a collection electrode that is formed of a porous material and means to effect a flow of gas from the clean side of the electrode, through the porous electrode, to dislodge solids collected on the electrode for cleaning purposes. A chamber is formed on the clean side of the collecting electrode and a jet pulse of gas is charged to the chamber, which pulse of gas is distributed through the porous collecting electrode to dislodge the solids from the collecting surface thereof. In one embodiment, a porous flexible member is disposed adjacent the collecting surface of the collecting electrode and the solids are deposited thereon and dislodged therefrom by passage of a gas through the porous collecting electrode.

10 Claims, 8 Drawing Figures

ELECTROSTATIC PRECIPITATOR WITH READILY CLEANABLE COLLECTING ELECTRODE

BACKGROUND OF THE INVENTION

Electrostatic precipitation for particulate removal from gas streams is a technology that has successfully found application in systems ranging from domestic use at a few hundred cubic feet per minute to power plant systems with several million cubic feet per minute. In this process, dust laden gas flows between two electrodes maintained at a large electrical potential difference. The potential difference must be large enough to cause current flow between the electrodes by corona discharge. This in turn, causes charging of the particulate entrained in the gas flow.

Upon accepting a net charge, the particulate experiences an electrostatic force causing it to migrate to the collecting electrode where it is captured and removed from the gas stream. The forces holding the particulate on the collecting electrode are both electrical and adhesive/cohesive in nature.

This overall process can be conducted in either of two general geometries. The first is a "wire and tube" arrangement. In this system, the high tension electrode (wire or rod-like assembly) is located centrally in a tubular electrode which serves as the collection electrode. As gas flow occurs through the tube, particulate is forced to the outer tube where it is collected. In the more common "parallel plate" arrangement, the collecting electrodes are comprised of many parallel plates separated by a distance of typically 0.3 meter. Discharge electrodes consisting of wires or other corona enhancing shapes are placed between the plates.

In all geometries, the dust must periodically be removed from the collection electrode in order to maintain the electric field between the electrodes. The process by which electrodes are cleaned usually consist of a mechanical "rapping" of the plate or tube in such a fashion that the resultant vibrations and accelerations are adequate to shear the dust cake at the elecrode/dust cake interface causing the deposits to shed in large chunks and fall into collection hoppers below. Recent studies of the rapping process and the resulting propagation and distribution of separating forces have helped to quantify the design problems associated with this method of cleaning.

Recently there has been considerable effort expended in an attempt to extend electrostatic precipitation technology into the range of high temperature and pressure that is consistent with advanced coal conversion technologies such as pressurized fluid bed combustion and gasification. The primary motivation for this work is that in the typical operating environment of high temperature and pressure, very large electric fields can be sustained prior to electrical breakdown and spark over. This results in larger electrostatic forces on the particulate and increased migration velocities to the collection electrode. The end result is that by comparison to current standard electrostatic precipitator design, very compact and highly efficient precipitators can be developed for high temperature, high pressure applications.

A serious design problem arises in high temperature, high pressure precipitator applications when the electrode cleaning method is considered. The conventional method of mechanically rapping the collecting surface is apt to be difficult if not impossible because at high temperature, the properties of the electrode are greatly altered. Virtually all metals have very little mechanical strength at temperatures exceeding 800°-900° C. and are unlikely to be capable of surviving the traditional mechanical rapping required for cleaning. In addition, the transmission and distribution of vibrations will be greatly diminished in these materials at high temperature. A final problem to be overcome is the design and operation of a system that is capable of delivering the rapping action to the collection plates. Either the design of a system to operate from within the pressure boundary or to penetrate it will be difficult and costly.

It is an object of the present invention to provide an electrostatic precipitator which has means for cleaning dust deposits from the collecting electrode without the need to physically rap the electrode.

It is a further object of the present invention to provide an electrostatic precipitator that is usable under high temperature and high pressure conditions and is readily cleaned.

SUMMARY OF THE INVENTION

In an electrostatic precipitator that has a housing containing at least one discharge electrode and at least one collecting electrode spaced therefrom to effect a corona discharge, with particular matter in a gas flowing therebetween being attracted to the collecting electrode, the collecting electrode is formed from a porous electrically conductive material and means are provided to pass a gas through the porous collecting electrode, from the side opposite the side on which the dust cake collects, to discharge a dust cake therefrom.

The electrostatic precipitator may be a wire and tube-type or wire and plate-type precipitator. The means for effecting a flow of gas through the porous collecting electrode is a source of pressurized gas which is charged to a chamber formed by a wall spaced from the porous collecting electrode and sealing means to seal the chamber such that a pulse of pressurized gas charged to the chamber will flow through the porous collecting electrode and discharge solids collected thereon.

In a further embodiment, a flexible porous member may be supported between the discharge electrode and the porous collecting electrode, adjacent the latter, such that the solids will deposit on the flexible porous member and may be discharged therefrom by passage of a flow of gas through the porous collecting electrode.

DETAILED DESCRIPTION

The present invention provides an improved electrostatic precipitator where the collecting electrodes are readily cleaned. The improved electrostatic precipitators, which may be of a wire and tube-type or a wire and plate-type, are especially useful in high temperature, high pressure applications where conventional "rapping" of the electrodes for cleaning purposes is prohibited.

Figure 1:
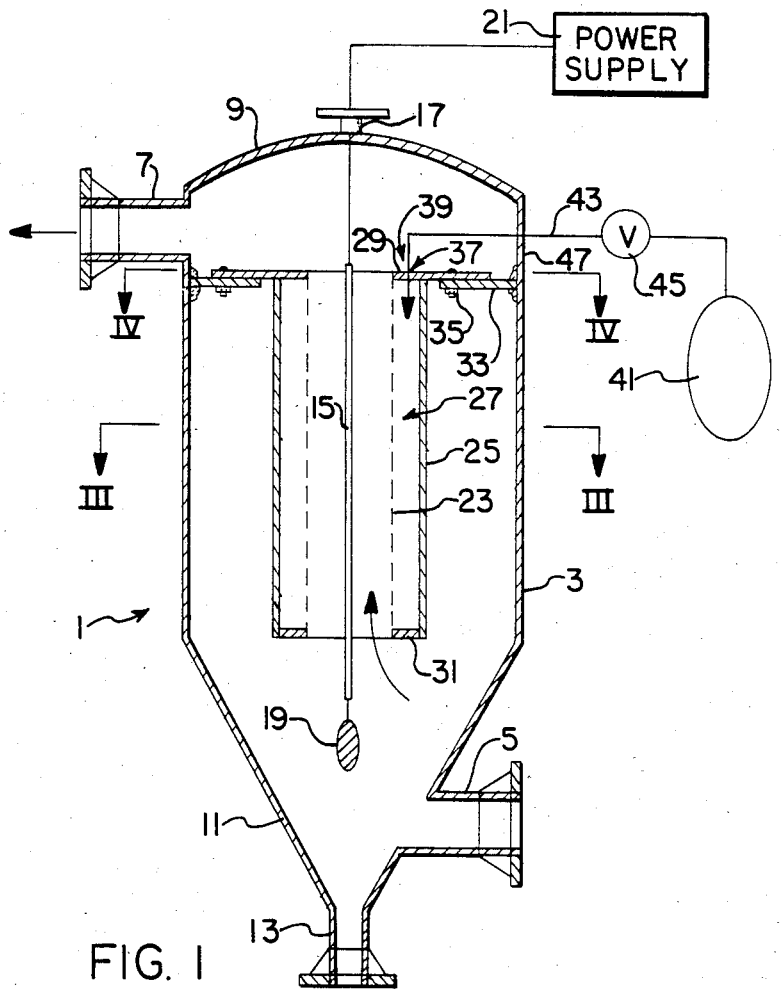
FIG. 1 is a cross-sectional view of an embodiment of the present invention in a wire and tube-type electrostatic precipitator.
Figure 2:
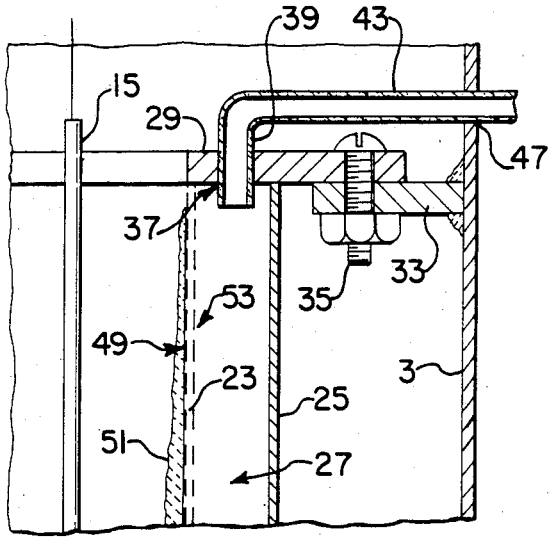
FIG. 2 is an enlarged sectional view showing the upper right hand portion of the wire and tube-type electrostatic precipitator illustrated in FIG. 1.
Figure 3:
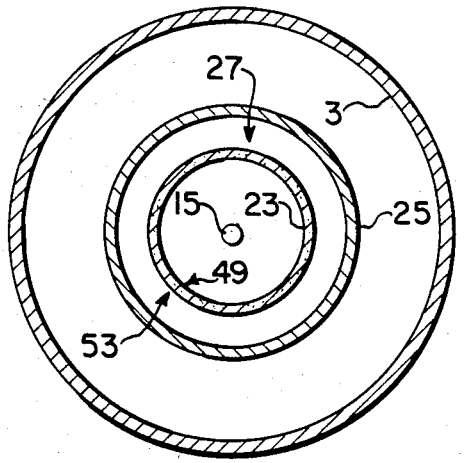
FIG. 3 is a view taken along lines III—III of FIG. 1.
Figure 4:
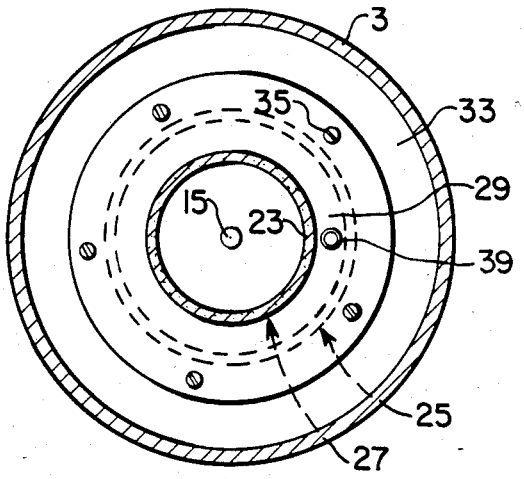
FIG. 4 is a view taken along lines IV—IV of FIG. 1.

Referring now to FIG. 1, the present invention is illustrated in a wire and tube-type construction of an electrostatic precipitator. The electrostatic precipitator 1, has a housing 3 which is of cylindrical cross-section, the housing receiving a flow of gases containing particulate matter through a bottom feed line 5, into the housing, and having a top discharge line 7 through which clean gases are discharged. The housing has a closed top portion 9 and a conical bottom portion 11 which leads into a solids outlet 13 that then empties into a solid discharge hopper (not shown). A discharge electrode 15 in the form of a wire-like or rod shape is suspended within the housing 3, from an insulated hanger 17, the wire 15 preferably having a weight 19 at the bottom for stability. A power supply 21 to provide the requisite electrical current is also provided, as is conventional.

In conventional wire and tube electrostatic precipitators, a solid tubular collecting electrode, which is grounded surrounds the wire discharge electrode and particulates are attracted to the collecting electrode through use of a corona discharge between the two electrodes.

In the present invention, a tubular collecting electrode 23 surrounds the discharge electrode, the tubular collecting electrode being formed from a porous material such as a porous sintered metal. The porous sintered metal is electrically conductive and may comprise a material used as metal filters. Coaxial with the porous tubular collecting electrode 23, and surrounding the same, is an imperforate tube 25 which forms an annular chamber 27 between the two tubes 23 and 25. A first radially outwardly extending flange 29 at the top of the porous tubular collecting electrode 23 seals the top of the chamber 27, while a second radially outwardly extending flange 31 seals the bottom of the chamber 27. Supports 33, on the interior wall of the housing 3, are used to mount the tubular assembly coaxially within the housing 3, such as by attachment with bolts 35.

At least one port 37 is provided through the flange 29 which communicates with the annular chamber 27 and an inlet nozzle 39 is connected to the port 37, which inlet nozzle is connected to a source of pressurized gas 41 through line 43 containing a valve 45. As illustrated, the valve 45 and source of pressurized gas are situated outside the housing 3, with the line 43 passing through an opening 47 in the wall 3.

During operation of the present electrostatic precipitator 1, a particulate-containing high temperature and pressure gas enters the bottom of the housing 3 through feed line 5 and passes upwardly towards the top 9. A corona discharge effected between discharge electrode 15 and the porous tubular collecting electrode 23 causes charged particules to deposit on the inner or collecting surface 49 as a collection of solids or dust cake 51. For periodic cleaning of the porous tubular collecting electrode 23 to dislodge collected solids 51, the valve 45 is momentarily energized and a high pressure pulse of gas flows through line 43 and nozzle 39 into the annular chamber 27. The flow resistance of the porous material comprising the porous tubular collecting electrode 23 causes the pulse flow to be uniformly distributed over the surface of that electrode and through that electrode from the side 53 thereof opposite the collecting surface 49, to dislodge the collected solids 51 from the collecting surface 49. Once the collected solids-collecting surface has been sheared, gravitational forces will cause sheets of the dust deposit to fall into the conical section 11 and through solids outlet 13 into a collection hopper below for subsequent removal.

Figure 5:
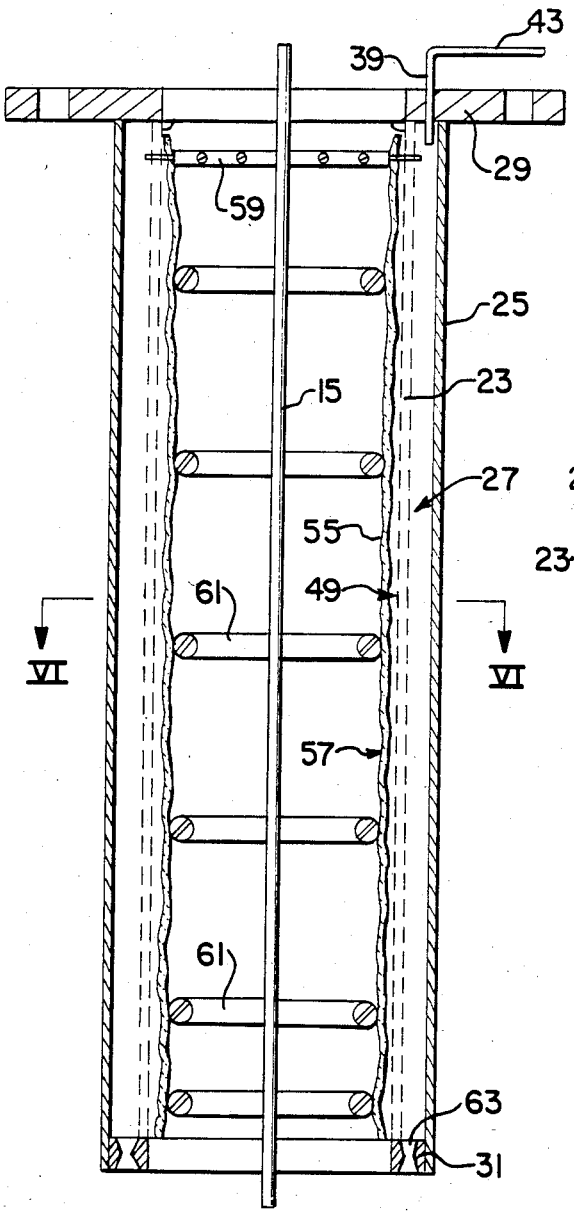
FIG. 5 is a sectional view illustrating the use of a porous flexible member in connection with a wire and tube-type electrostatic precipitator of the present invention.
Figure 6:
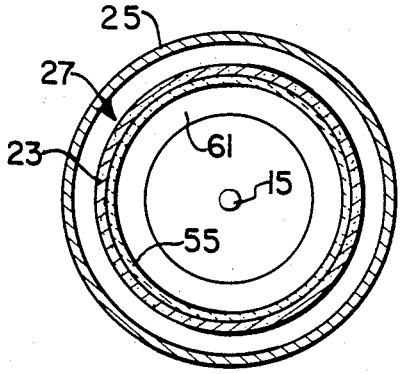
FIG. 6 is a view taken along lines VI—VI of FIG. 5.

In another embodiment of the present invention, illustrated in FIGS. 5 and 6, for use with a wire and tube-type construction of an electrostatic precipitator, a porous flexible tubular member 55, such as a ceramic cloth tube, is disposed between the wire-like discharge electrode 15 and the coaxial porous tubular collecting electrode 23, adjacent the collecting surface 49 thereof. The porous flexible tubular member 55 can consist of a conductive metallic cloth or mesh, or it can be fabricated from a ceramic woven cloth. The ceramic woven cloth need only have enough porosity to allow the flow of electrical current due to the corona.

In the embodiment illustrated in FIGS. 5 and 6, the particulate material, rather than being deposited on the surface 49 of the porous tubular collecting electrode 23, while being attracted thereto, will deposit on the interior surface 57 of the porous flexible tubular member 55. In this instance, cleaning of the dust cake from the porous flexible tubular member is effected by a jet pulse of pressurized gas being charged to the annular chamber 27, with the gas flowing through the porous tubular collecting electrode 23 and will cause the adjacent porous flexible tubular member 55 to flex and dislodge collected particulates from the surface 57 thereof.

Since the surface 57 of the porous flexible tubular member 55 collects the particular material, and such particular material does not pass through the porous flexible tubular member 55, the porous tubular collecting electrode 23 can be fabricated from a punched sheet of electrically conductive metallic material, and may be provided with a descrete pattern of apertures. Thus, a sintered porous metallic tube is not needed. The apertured tube need only be resistant enough to effect adequate distribution of the flow of cleaning gas passing therethrough.

The porous flexible tubular member 55 may be attached to the porous tubular collecting electrode 23 by a circumferential clamp 59 at the top region thereof. The attachment at the bottom would require the ability to allow dust to fall from between the porous flexible tubular member 55 and the porous tubular collecting electrode 23, since some particulate material will finds its way into this area and provision must be made for its removal. Also, means must be provided to keep the porous flexible tubular member 55 closely adjacent the porous tubular collecting electrode 23. Both these requirements are fulfilled by incorporation of a plurality spaced rings 61 along the porous flexible tubular member 55. The rings 61 are rigid and of a size so that the porous flexible tubular member 55 can move and flex during cleaning and still allow dust to slide down and out of the area between the porous flexible tubular member and the porous tubular collecting electrode 23.

When the porous tubular collecting electrode 23 is formed as a perforated member, there is a likelihood that dust will eventually get into the chamber 27. By forming a plurality of small holes 63, in the bottom flange 31 that seals the chamber 27, the chamber 27 may also be purged clean during the cleaning cycle for the porous flexible tubular member 55.

Figure 7:
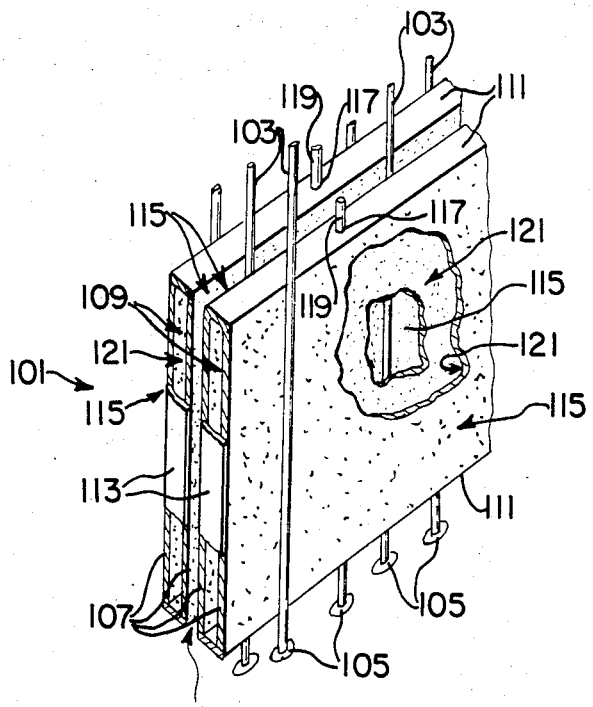
FIG. 7 is a partial cross-sectional view of a wire and plate arrangement of a wire and plate-type electrostatic precipitator according to the present invention.
Figure 8:
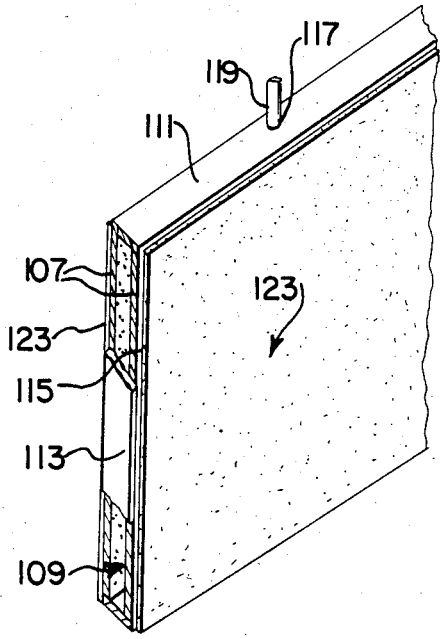
FIG. 8 is a view showing use of a porous flexible member in connection with a wire and plate-type electrostatic precipitator of the present invention.

Another embodiment of the present invention is illustrated in FIGS. 7 and 8 which shows the present invention used in connection with a wire and plate-type construction of an electrostatic precipitator. As is known, in a wire and plate-type electrostatic precipitator, a plurality of vertical discharge electrodes are arranged in a row and situated between spaced vertical parallel plates or collecting electrodes, the electrodes maintained in a housing through which the gas is passed. The gas may flow vertically upward between the plates but preferably flows horizontally between the plates.

As illustrated, in this embodiment 101, a plurality of wire-like discharge electrodes 103 preferably having weights 105 or other stabilizing means, are arranged in a row between pairs of spaced parallel collecting electrode plates 107. The collecting electrode plates are formed from a porous material such as a sintered metal. Facing porous plates 107 are situated one on each side of a row of discharge electrodes 103, and are spaced therefrom a distance that provides for a corona discharge. An electric source, not shown, is provided to produce the corona.

As illustrated, with a pair of spaced parallel collecting electrodes 107 provided between the rows of discharge electrodes 103, two such collecting electrodes 107 face each row of discharge electrodes 103 and a chamber 109 is formed between each said pair. The chamber 109 between each pair of spaced collecting electrodes 107 is sealed by end sealing walls 111 and side sealing walls 113 which extend between the spaced collecting electrodes 107. Portions of the end sealing walls are broken away in the drawings to better illustrate the present embodiment. There are thus provided collecting surfaces 115 on each collecting electrode 107 facing a row of discharge electrodes 103. At least one port 117 is provided in a sealing wall which communicates with the chamber 109, and an inlet nozzle 119 is connected to the port 117 and to a source of pressurized gas (not shown) as in the first described embodiment of the present invention. Although only two such pairs of spaced collecting electrodes 107 are illustrated, in actual use, many such pairs may be used, one such pair between spaced rows of discharge electrodes 103.

In operation of the embodiment of FIG. 7, the wire and plate-type electrostatic precipitator 101 is enclosed in a housing, as in the first embodiment described, for flow of gases therethrough. A corona discharge is effected between the discharge electrodes 103 and the porous collecting electrode plates 107, with charged particles collecting on collecting surface 115. For periodic cleaning of the porous collecting electrode plates 107, a surge of gas is charged through nozzle 119 into the sealed chamber 109. This pulse flow is passed through the porous collecting electrode plates 107 from the side 121 thereof opposite the collecting surface 115, to dislodge the collected solids therefrom.

In the embodiment of FIG. 8, a wire and plate-type electrostatic precipitator, similar to that previously described, has a porous flexible planar member 123 disposed between the row of discharge electrodes 103 and adjacent each collecting surface 115 of a porous collecting electrode 107. The porous flexible planar member 123 may be affixed to the porous collecting electrode 107 by bolts, clamps, or the like. The porous flexible planar member 123 may comprise a conductive metallic cloth, or a ceramic woven cloth having enough porosity to allow the flow of electrical current due to the corona. The particulate material will thus be deposited on the porous flexible planar member 123, while being attracted to the porous collecting electrode 107. Cleaning, as with the previous embodiment, is effected by a jet pulse of air directed into the chamber 109, through each porous collecting electrode 107 of a pair, and then through the adjacently positioned porous flexible planar member 123.

In both of the embodiments of electrostatic precipitators described, the wire and tube-type electrostatic precipitator and the wire and plate-type electrostatic precipitator, porous collecting electrodes are required, and cleaning of the collecting electrode is effected by passage of a gas through the porous electrode from the side thereof opposite the side on which the deposited solids are collected.

The electrostatic precipitator of the present invention is especially useful in high temperature, high pressure applications where rapping or other physical contact with the collecting electrode of an electrostatic precipitator is detrimental to the electrode.

What is claimed is:

1. In an electrostatic precipitator having a housing for the flow of gases containing particulate matter therethrough, at least one discharge electrode and at least one collecting electrode positioned in a spaced relationship to the discharge electrode to effect a corona discharge therebetween, and a feed line to said housing and discharge line from the housing to effect passage of said flow of gases through said housing between said discharge electrode and collecting electrode, to cause migration of particulate matter in said gas towards the collecting electrode for collection on the collecting surface of the collecting electrode facing the discharge electrode, the improvement wherein:

said discharge electrode is a wire electrode;

said collecting electrode is a coaxial tubular porous electrode surrounding said wire electrode;

means are provided to effect a flow of gas through the porous collecting electrode from the side of the collecting electrode opposite said collecting side to dislodge collected solids therefrom, comprising an impervious tube surrounding said collecting electrode to form an annular chamber therebetween;

means are provided for sealing the chamber at the ends of said coaxial tubes; and means are provided for injecting a pressurized flow of gas into said annular chamber for passage through said porous collecting electrode.

2. In an electrostatic precipitator as defined in claim 1, the improvement wherein said means for sealing the chamber comprises a pair of radially outwardly extending flanges one such flange at each end of said collecting electrode, with said impervious tube extending between said pair of flanges.

3. In an electrostatic precipitator as defined in claim 2 the improvement wherein said means for injecting a flow of gas into said annular chamber comprises a port in one of said flanges, between the collecting tube and the impervious tube, an inlet nozzle extending through said port, and a source of pressurized gas connecting to said inlet nozzle.

4. In an electrostatic precipitator as defined in claim 2, the improvement wherein said housing has a cylindrical wall and an inwardly directed support extending from said wall, and a flange of said collecting electrode is attached to said support to coaxially dispose the collecting electrode and impervious tube within the cylindrical wall of the housing.

5. In an electrostatic precipitator as defined in claim 1 the improvement wherein a porous flexible tubular member is disposed between said wire discharge electrode and said coaxial tubular porous electrode, adjacent the collecting surface of the tubular porous electrode, whereby particulate material is collected on said flexible tubular member.

6. In an electrostatic precipitator as defined in claim 5, the improvement wherein said porous flexible tubular member is formed of an electrically conductive metal cloth.

7. In an electrostatic precipitator as defined in claim 5, the improvement wherein said porous flexible tubular member is formed of a ceramic woven cloth.

8. In an electrostatic precipitator having a housing for the flow of gases containing particulate matter therethrough, at least one discharge electrode and at least one collecting electrode positioned in a spaced relationship to the discharge electrode to effect a corona discharge therebetween, and a feed line to said housing and discharge line from the housing to effect passage of said flow of gases through said housing between said discharge electrode and collecting electrode, to cause migration of particulate matter in said gas towards the collecting electrode for collection on the collecting surface of the collecting electrode facing the discharge electrode, the improvement wherein:

said at least one discharge electrode comprises a row of wire electrodes, and said collecting electrode comprises two facing porous plates coplanar with said row of wire discharge electrodes, one of said two porous plates located on each side of said row of wire discharge electrodes;

means are provided to effect a flow of gas through the porous collecting electrode from the side of the collecting electrode opposite said collecting side to dislodge collected solids therefrom, comprising a pair of spaced collecting electrodes between adjacent rows of discharge electrodes, to form a chamber between said pair of collecting electrodes;

means are provided for sealing the chamber at the ends of said pair of collecting electrodes;

means are provided for injecting a pressurized flow of gas into said chamber for passage through said porous collecting electrodes; and a porous planar flexible member is provided between said row of wire discharge electrodes and each of said two facing porous plates, adjacent the collecting surface of the porous plate, whereby particulate material is collected on said porous planar flexible member.

9. In an electrostatic precipitator as defined in claim 8, the improvement wherein said porous flexible member is formed of an electrically conductive metal cloth.

10. In an electrostatic precipitator as defined in claim 8, the improvement wherein said porous flexible member is formed of a ceramic woven cloth.

* * * * *